US012435631B2

(12) United States Patent
Yin et al.

(10) Patent No.: US 12,435,631 B2
(45) Date of Patent: Oct. 7, 2025

(54) GRADED PLUGGING, MONITORING AND REINFORCING INTEGRATED METHOD FOR SEPARATION STRATUM GROUTING UNDER SINGLE-SIDE OPEN CONDITIONS

(71) Applicant: SHANDONG UNIVERSITY OF SCIENCE AND TECHNOLOGY, Shandong (CN)

(72) Inventors: Dawei Yin, Shandong (CN); Zhe Liu, Shandong (CN); Lei Han, Shandong (CN); Shaojie Chen, Shandong (CN); Shouqian Sheng, Shandong (CN); Qi Xu, Shandong (CN); Yiqun Zhang, Shandong (CN); Shouzhen Xue, Shandong (CN)

(73) Assignee: SHANDONG UNIVERSITY OF SCIENCE AND TECHNOLOGY, Qingdao (CN)

( * ) Notice: Subject to any disclaimer, the term of this patent is extended or adjusted under 35 U.S.C. 154(b) by 0 days.

(21) Appl. No.: 19/021,122

(22) Filed: Jan. 14, 2025

(65) Prior Publication Data

US 2025/0290417 A1 Sep. 18, 2025

(30) Foreign Application Priority Data

Mar. 13, 2024 (CN) ..... CN202410283189.3

(51) Int. Cl.
*E21F 17/00* (2006.01)
*E21F 17/103* (2006.01)

(52) U.S. Cl.
CPC ..... *E21F 17/103* (2013.01)

(58) Field of Classification Search
CPC ..... E21F 17/103; E21F 17/16; E21F 17/00; E21F 18/70; E21F 15/00; E21F 18/70;
(Continued)

(56) References Cited

U.S. PATENT DOCUMENTS 1,327,268 A * 1/1920 Christians ..... E21B 33/138 405/265
1,394,718 A * 10/1921 Emery ..... E21D 1/16 405/266

(Continued)

FOREIGN PATENT DOCUMENTS

CN 116163798 A 5/2023
CN 116557051 A 8/2023
CN 117231293 A 12/2023

*Primary Examiner* — Edwin J Toledo-Duran

(57) ABSTRACT

Disclosed is a graded plugging, monitoring and reinforcing integrated method for separation stratum grouting under single-side open conditions, falling within the technical field of coal mine filling and mining. The method specifically includes the following steps: analyzing the development law of a separation stratum, determining the scope of protective coal pillars for a surface building/structure, constructing a combined plugging dam, monitoring and evaluating the combined plugging dam, and implementing local reinforcement measures. The combined plugging dam proposed in the present disclosure can effectively prevent grout from flowing and migrating towards the remaining space of a target separation stratum above a mined area during grouting under single-side open conditions, enhancing the effectiveness of separation stratum grouting.

8 Claims, 5 Drawing Sheets

(58) Field of Classification Search
CPC .. E21F 16/00; E21F 17/18; E02B 3/10; E21B 7/04; E21B 33/13; E21B 47/022; E02D 3/12; E02D 15/04
See application file for complete search history.

(56) References Cited

U.S. PATENT DOCUMENTS 1,858,952 A * 5/1932 Christians ..... E02D 3/12 405/265
1,867,758 A * 7/1932 Ranney ..... E21B 43/295 299/2
3,469,405 A * 9/1969 Reinhold ..... E02D 19/16 405/266
3,583,165 A * 6/1971 West ..... E21F 15/00 405/266
3,613,382 A * 10/1971 Dickinson ..... E02B 3/066 405/285
4,130,164 A * 12/1978 Datta ..... E21B 43/295 166/266
4,300,397 A * 11/1981 Brest van Kempen ..... E21F 17/185 73/818
4,309,059 A * 1/1982 Walsh ..... E21D 15/483 299/11
9,551,126 B1 * 1/2017 Schmall ..... E02D 3/12
11,162,346 B2 * 11/2021 Montalvo ..... E21B 43/25
2014/0318771 A1 * 10/2014 Gray ..... E21B 33/13 166/250.14
2016/0176639 A1 * 6/2016 Gu ..... B65G 5/00 405/117
2016/0201460 A1 * 7/2016 Gu ..... E02B 3/10 405/55
2020/0240270 A1 * 7/2020 Shan ..... E21F 17/103
2021/0156810 A1 * 5/2021 Botto ..... G01N 23/2251
2023/0075452 A1 3/2023 Wang et al.

* cited by examiner

GRADED PLUGGING, MONITORING AND REINFORCING INTEGRATED METHOD FOR SEPARATION STRATUM GROUTING UNDER SINGLE-SIDE OPEN CONDITIONS

CROSS-REFERENCE TO RELATED APPLICATION

This application claims priority of Chinese Patent Application No. 202410283189.3, filed on Mar. 13, 2024, the entire contents of which are incorporated herein by reference.

TECHNICAL FIELD

The present disclosure relates to the technical field of coal mine filling and mining, and in particular to a graded plugging, monitoring and reinforcing integrated method for separation stratum grouting under single-side open conditions.

BACKGROUND

Separation stratum grouting under single-side open conditions refers to a partial separation stratum grouting and filling technique, involving that holes for separation stratum grouting are first drilled at a certain position ahead of the advancement direction of a coal mining face to a stop-mining line area. When the target grouting separation stratum develops to the grouting holes along with the advancement of the coal mining face, separation stratum grouting is performed until the entire coal mining face is completely mined. However, due to the target separation stratum being interconnected, the grout will flow and migrate towards the remaining space of the target separation stratum above the mined area during separation stratum grouting under single-side open conditions, reducing the effectiveness of grouting and filling.

In existing patents, a construction process for plugging surface grout leakage in overlying strata isolation grouting projects with the publication number of CN201910270085.8 involves that after comparing the amount of grout leakage, different grouts are employed to grout the leakage points, followed by hydraulic pressure test, achieving plugging of the leakage source. A detection and reinforcement integrated method after overlying separation strata grouting with the publication number of CN202210052190.6 involves that the source of subsidence is analyzed through construction detection and reinforcement of drilling holes, and then grouting reinforcement is performed by combining the survey results from the surface subsidence surveyed line. A method for real-time monitoring of grout migration and coagulation in goaf areas through drilling holes with the publication number of CN202310367140.1 involves that a monitoring device is placed inside the drilling hole to monitor changes in resistivity before and after grouting, and comparative testing with indoor grout is conducted to analyze the flow and coagulation laws of the grout, ensuring subsequent grouting effectiveness and sensor monitoring effectiveness. A device for grouting and plugging fractures in overlying separation strata with the publication number of CN202010825166.2 involves that grouting plugging capability is increased by injecting grout with gradually increased concentration/viscosity, ensuring plugging effectiveness. However, the above prior arts mainly involve plugging and leak prevention, monitoring of grouting effectiveness, and other aspects related to the separation strata above the entire coal mining face. Currently, there is no specific technology involving plugging, monitoring and reinforcing for separation stratum grouting above the coal mining face under single-side open conditions.

SUMMARY

To solve the above technical problem existing in the prior art, the present disclosure provides a graded plugging, monitoring, and reinforcing integrated method for separation stratum grouting under single-side open conditions. The combined plugging dam constructed can effectively prevents the grout from flowing and migrating towards the remaining space of the target separation stratum above the mined area during separation stratum grouting under single-side open conditions, enhancing the effectiveness of separation stratum grouting.

To achieve the above objective, the present disclosure provides the following technical solution: a graded plugging, monitoring and reinforcing integrated method for separation stratum grouting under single-side open conditions includes the following steps:

S1. analyzing the development law of a separation stratum, and determining the scope of protective coal pillars for a surface building/structure;

S2. constructing a combined plugging dam;

S3. monitoring and evaluating the combined plugging dam; and

S4. determining whether there is grout leakage in the combined plugging dam, if there is, performing local reinforcement on the combined plugging dam, and otherwise, requiring no local reinforcement.

In a preferred example, in S1, the analyzing the development law of a separation stratum, and determining the scope of protective coal pillars for a surface building/structure specifically includes the following steps: determining burial depth of coal stratum, scope of mining area, and mining height data according to relevant geological data; studying rock stratum movement characteristics, analyzing the development law of an overlying separation stratum, and clarifying grouting separation stratum horizon, whether the separation stratum is closed, and whether the key stratum is fractured by combining physical simulation, numerical simulation, and theoretical analysis methods; obtaining a periodic movement step distance 1 of a target key stratum and a movement angle of rock stratum under the condition of separation stratum grouting according to the rock stratum movement characteristics and the development law of overlying separation stratum; and determining the boundary of protective coal pillars for the surface building/structure according to the obtained movement angle of rock stratum and a rock stratum thickness.

In a preferred example, the scope of protective coal pillar for the surface building/structure under the condition of separation stratum grouting is expressed as:

$$L_b = L_{building} + 2(a + H_s/\tan\varphi + H_{d1}/\tan\beta + H_{d2}/\tan\delta)$$

where $L_b$ represents the scope of protective coal pillars for a building/structure, in unit m; $L_{building}$ represents a length of the building/structure, in unit m; a represents a safety distance, in unit m; $H_s$ represents a thickness of an unconsolidated stratum, in unit m; φ represents a movement angle of the unconsolidated stratum, in unit °; $H_{d1}$ represents a thickness of bedrock in a grouting stratum-unconsolidated stratum section, in unit m; β represents a movement angle of bedrock in the grouting stratum-unconsolidated stratum section, in unit °; $H_{d2}$ represents a thickness of bedrock in a coal stratum-grouting stratum section, in unit m; and δ represents a movement angle of bedrock in the coal stratum-grouting stratum section, in unit °.

In a preferred example, after determining the scope of protective coal pillars for the surface building/structure, along the advancement direction of the coal mining face, dam grouting holes are constructed at a distance of L meters from the building/structure on the surface of the coal mining face.

$$L = a + H_s/\tan\varphi + H_{d1}/\tan\beta + H_{d2}/\tan\delta$$

where L represents the scope of protective coal pillars on the left side of the surface building/structure, in unit m.

In a preferred example, in S2, the constructing a combined plugging dam includes the following specific steps: constructing three rows of dam grouting holes at surface above the boundary of protective coal pillar along the advancement direction of the coal mining face, with the periodic movement step distance 1 of the target key stratum as a drilling spacing; and firstly injecting first-grade grout into first-grade dam grouting holes, then injecting second-grade grout into second-grade dam grouting holes, and finally injecting third-grade grout into third-grade dam grouting holes, to isolate the remaining space of the target separation stratum above the mined area from the space of undeveloped separation stratum ahead of the advancement direction of the coal mining face.

In a preferred example, the first-grade grout is prepared from quick-drying cement, sawdust, crushed straw, and other materials (including but not limited to materials with equivalent effects); the second-grade grout is prepared from ordinary cement, sawdust, crushed straw, and other materials (including but not limited to materials with equivalent effects); and the third-grade grout is prepared from flyash, sawdust, crushed straw, and other materials (including but not limited to materials with equivalent effects).

In a preferred example, in S3, the condition of the combined plugging dam is monitored by combining an orifice grouting pressure, geophysical exploration methods (such as direct current resistivity method, transient electromagnetic method, and seismic reflection wave method), and drilling exploration methods (such as borehole television imaging technology); and whether there is grout leakage in the combined plugging dam is determined according to the orifice grouting pressure and geophysical exploration and drilling exploration results.

In a preferred example, the magnitude of the orifice grouting pressure is determined through the following formula:

$$P_{hole} = P_{inject} - H_1\gamma_1 \geq P_{stratum} - H_1\gamma_1 = H_1(\gamma - \gamma 3)$$

where $P_{hole}$ represents the orifice grouting pressure of the grouting hole, in unit MPa; $P_{inject}$ represents a grouting filling pressure, in unit MPa; $P_{stratum}$ represents a natural pressure of the stratum above the grouting filling stratum, in unit MPa; $H_1$ represents a hole depth from the surface to the grouting filling horizon, in unit m; γ represents comprehensive specific gravity of the stratum above the grouting filling stratum, in unit kN/m$^3$; and $\gamma_1$ represents specific gravity of the filling grout, in unit kN/m$^3$.

In a preferred example, criteria for determining whether there is grout leakage in the combined plugging dam are as follows: in a case that the orifice grouting pressure P remains relatively constant ($P=P_{hole}\pm 20\%$) and the geophysical and drilling exploration results show no gaps between the dam and the overlying stratum, the combined plugging dam is considered intact and without leakage; and in a case that the orifice grouting pressure P continuously decreases ($P<P_{hole}\pm 20\%$) and the geophysical and drilling exploration results show gaps between the dam and the overlying stratum, the combined plugging dam is considered to be leaking, and local reinforcement of the combined plugging dam is required.

In a preferred example, if there is grout leakage in the combined plugging dam, the leakage is plugged by pressure grouting through the grouting holes of the combined plugging dam using grout prepared from ultrafine cement mixed with sawdust, crushed straw, and other materials (including but not limited to materials with equivalent effects); and during grouting plugging of the combined plugging dam and subsequent grouting filling, the combined plugging dam is continuously monitored by combining the orifice grouting pressure with geophysical and drilling exploration methods.

Compared with the prior art, the graded plugging, monitoring and reinforcing integrated method for separation stratum grouting under single-side open conditions provided by the present disclosure has the following advantageous effects.

(1) In the present disclosure, the combined plugging dam constructed can effectively prevent the grout from flowing and migrating towards the remaining space of the target separation stratum above the mined area during separation stratum grouting under single-side open conditions, enhancing the effectiveness of separation stratum grouting.

(2) In the present disclosure, injecting different modified grouts into different dam grouting holes constructs the combined plugging dam, effectively reducing costs compared to constructing the dam solely with cement grout.

(3) The method for constructing the combined plugging dam proposed by the present disclosure comprehensively considers the positional relationship between the grouting holes of the combined plugging dam and the remaining space of the target separation stratum above the mined area, as well as the properties of grouting materials. This allows for effective isolation of the remaining space of the target separation stratum above the mined area from the space of undeveloped separation stratum ahead of the advancement direction of the coal mining face.

(4) In the present disclosure, the condition of the combined plugging dam is monitored by integrating orifice grouting pressure, and geophysical and drilling exploration methods. Whether grout leakage is present in the dam is determined according to the magnitude of the orifice grouting pressure and the geophysical and drilling exploration results.

(5) When the grout leakage is present in the dam, the grout prepared from ultrafine cement and materials such as sawdust, crushed straw, and other materials (including but not limited to materials with equivalent effects) is injected into the dam grouting holes, achieving rapid and effective plugging of the dam.

BRIEF DESCRIPTION OF THE DRAWINGS

As a part of the specification, the accompanying drawings are used for providing further understanding of the present disclosure, and for explaining the present disclosure together with examples of the present disclosure, rather than limiting the present disclosure. Among them.

Figure 1:
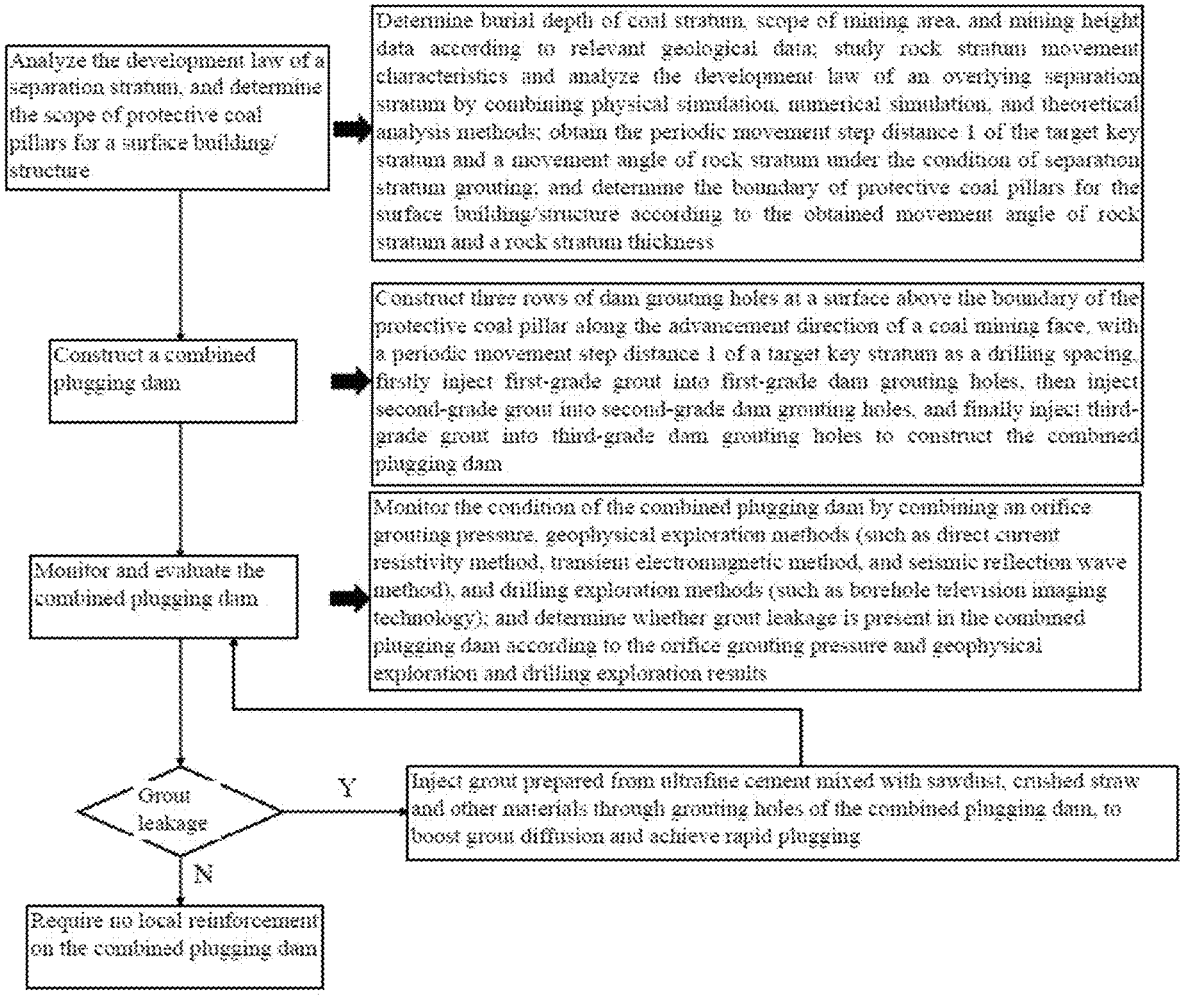
FIG. 1 is a flowchart for a graded plugging, monitoring and reinforcing integrated method for separation stratum grouting under single-side open conditions according to an example of the present disclosure.

Reference numerals and denotations thereof: 1—surface building/structure; 2—dam grouting hole; 21—first-grade dam grouting hole; 22—second-grade dam grouting hole; 23—third-grade dam grouting hole; 3—ordinary grouting hole; 4—combined plugging dam; 5—flyash grout; 6—target separation stratum; 7—remaining space of target separation stratum; and 8—grouting stratum.

DETAILED DESCRIPTION

The technical solutions of the examples in the present disclosure will be described clearly and completely by reference to the accompanying drawings of the examples in the present disclosure below. Obviously, the examples described are only some, rather than all examples of the present disclosure. The components of examples of the present disclosure generally described and illustrated in the accompanying drawings herein may be arranged and designed in a variety of different configurations. Therefore, the detailed description of the examples of the present disclosure provided in the accompanying drawings is not intended to limit the scope claimed by the present disclosure, but merely to represent selected examples of the present disclosure. Based on the examples of the present disclosure, all other examples obtained by those ordinary skilled in the art without creative efforts fall within the scope of protection of the present disclosure.

The example provides a graded plugging, monitoring and reinforcing integrated method for separation stratum grouting under single-side open conditions, including the specific steps as shown in FIGS. 1-6.

(1) The development law of a separation stratum is analyzed, and the scope of protective coal pillars for a surface building/structure is determined.

According to relevant geological data, data such as burial depth of coal stratum, scope of mining area, and mining height is determined. Combining methods such as physical simulation, numerical simulation, and theoretical analysis, rock stratum movement characteristics are studied, the development law of overlying separation stratum is analyzed, and grouting separation stratum horizon, whether the separation stratum is closed, and whether the key stratum is fractured are clarified. According to the rock stratum movement characteristics and the development law of overlying separation stratum, the periodic movement step distance 1 of the target key stratum and a movement angle of rock stratum under the condition of separation stratum grouting are obtained. Furthermore, according to the movement angle of rock stratum and the rock stratum thickness, the boundary of protective coal pillar for the surface building/structure is determined. The steps for determining the scope of protective coal pillar for the surface building/structure 1 under the condition of separation stratum grouting are as follows.

Figure 2:
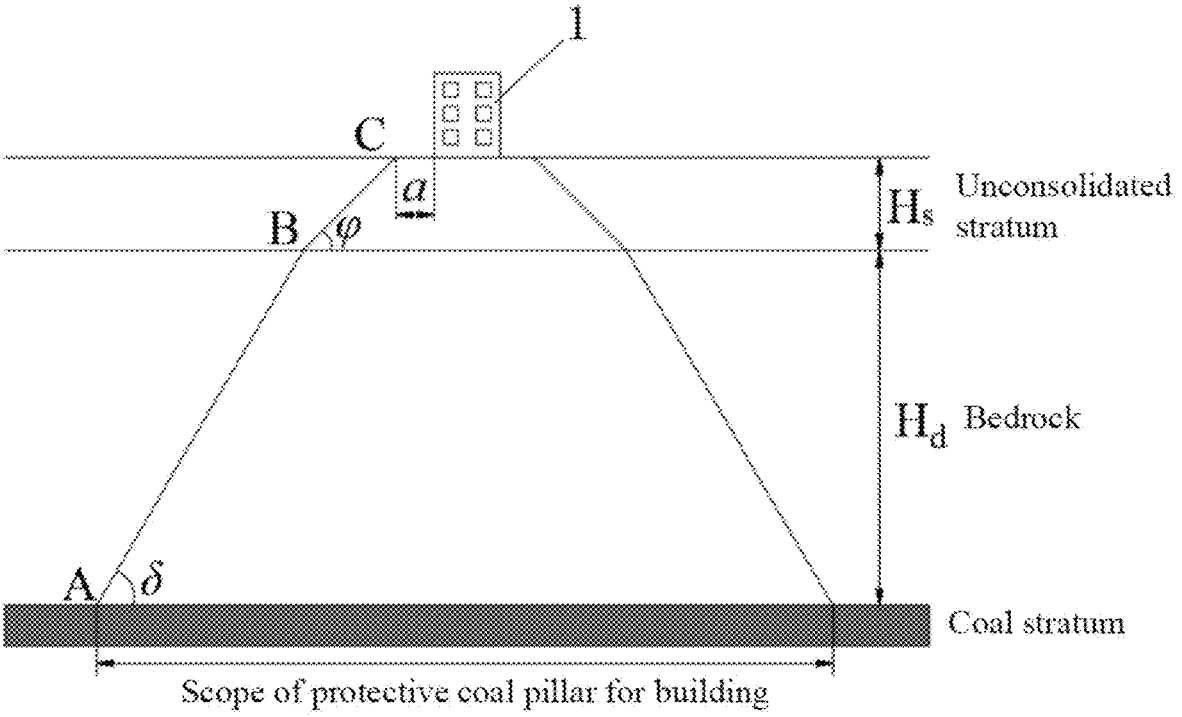
FIG. 2 is a schematic diagram of a movement angle of rock stratum after normal mining is completed in an example of the present disclosure.

1) After normal mining is completed, a movement angle of unconsolidated stratum q and a movement angle of bedrock δ above the coal stratum are determined by combining methods such as physical simulation and field measurements. As shown in FIG. 2. the movement angle of unconsolidated stratum φ is an angle between the line connecting point C (where the surface subsides by 10 mm) and point B (where the line drawn from the goaf area boundary through the bedrock movement angle intersects the interface between the bedrock and unconsolidated stratum) and the horizontal line on the coal pillar side. The movement angle of bedrock δ refers to an angle between a line connecting point B (where the line drawn from the movement angle of the unconsolidated stratum intersects the interface between the base rock and the unconsolidated stratum) to the boundary of the goaf area and the horizontal line on the coal pillar side.

Figure 3:
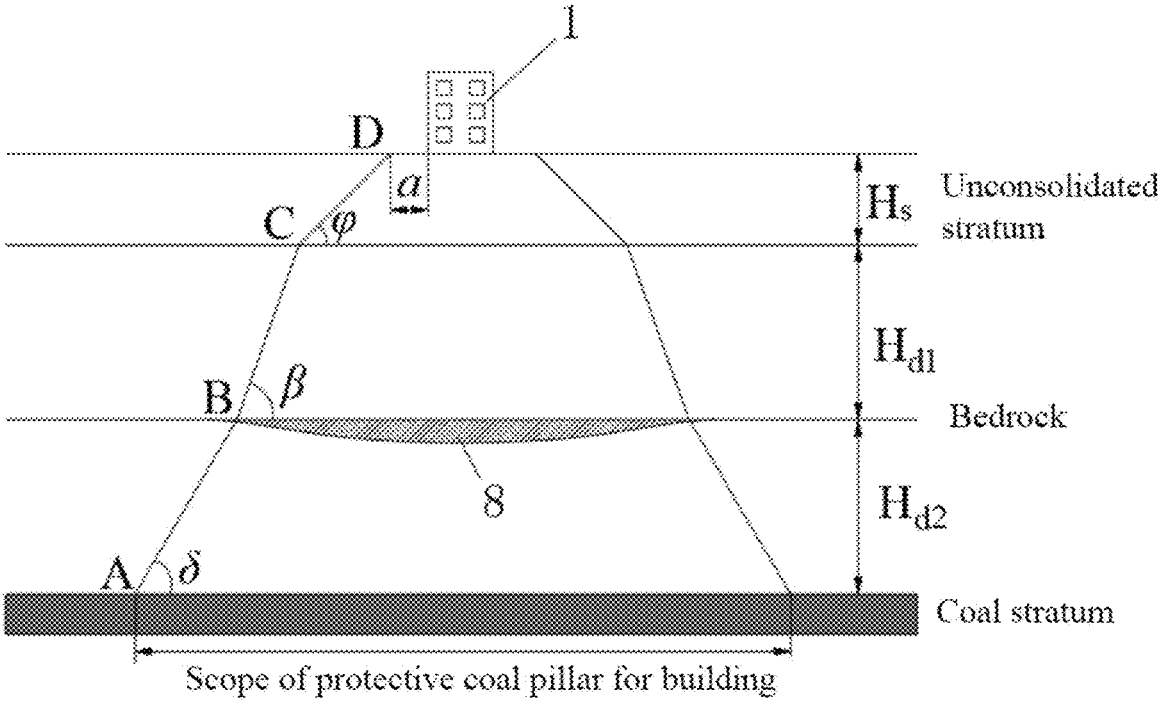
FIG. 3 is a schematic diagram of a movement angle of rock stratum after separation stratum grouting and mining are completed in an example of the present disclosure.

2) After mining and grouting of separation stratum are completed, the bedrock is divided into two parts: a coal stratum-grouting stratum section and a grouting stratum-unconsolidated stratum section. A movement angle of bedrock in the coal stratum-grouting stratum section is δ. As shown in FIG. 3, the positions of points B and C can be determined according to the movement angle of unconsolidated stratum φ and the movement angle of bedrock δ in the coal stratum-grouting stratum section. Combining methods such as physical simulation and numerical simulation, a horizontal projection distance of segment BC is determined, and a movement angle of bedrock β in the grouting stratum-unconsolidated stratum section is further determined.

3) The scope of protective coal pillars for the surface building/structure 1 under the condition of separation stratum grouting can be determined according to the movement angle of unconsolidated stratum φ, the movement angle of bedrock δ in the coal stratum-grouting stratum section, the movement angle of bedrock β in the grouting stratum-unconsolidated stratum section, and the rock stratum thickness in each section.

$$L_b = L_{building} + 2\left(a + H_s/\tan\varphi + H_{d1}/\tan\beta + H_{d2}/\tan\delta\right) \quad (1)$$

where $L_b$ represents the scope of protective coal pillars for a building/structure, in unit m; $L_{building}$ represents a length of the building/structure, in unit m; a represents a safety distance, in unit m; $H_s$ represents a thickness of an unconsolidated stratum, in unit m; φ represents a movement angle of the unconsolidated stratum, in unit °; $H_{d1}$ represents a thickness of bedrock in the grouting stratum-unconsolidated stratum section, in unit m; B represents a movement angle of bedrock in the grouting stratum-unconsolidated stratum section, in unit °; $H_{d2}$ represents a thickness of bedrock in the coal stratum-grouting stratum section, in unit m; and δ represents a movement angle of bedrock in the coal stratum-grouting stratum section, in unit °.

After determining the scope of protective coal pillars for the surface building/structure 1, along the advancement direction of the coal mining face, dam grouting holes 2 are constructed at a distance of L meters from the building/structure on the surface of the coal mining face.

$$L = a + H_s/\tan\varphi + H_{d1}/\tan\beta + H_{d2}/\tan\delta \quad (2)$$

where L represents the scope of protective coal pillars on the left side of the surface building/structure, in unit m.

(2) A combined plugging dam 4 is constructed.

Figure 4:
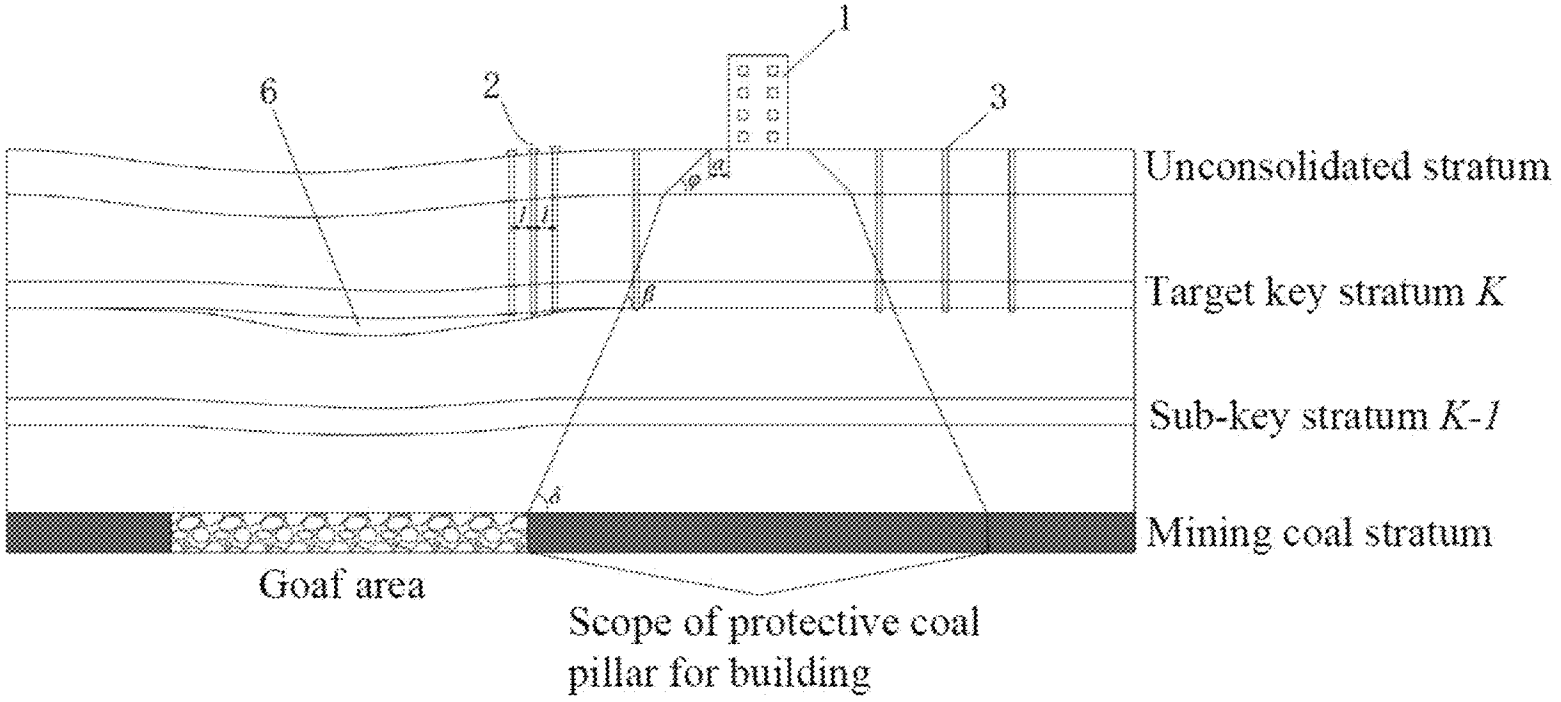
FIG. 4 is a schematic diagram showing separation stratum development and drilling hole layout in an example of the present disclosure.
Figure 5:
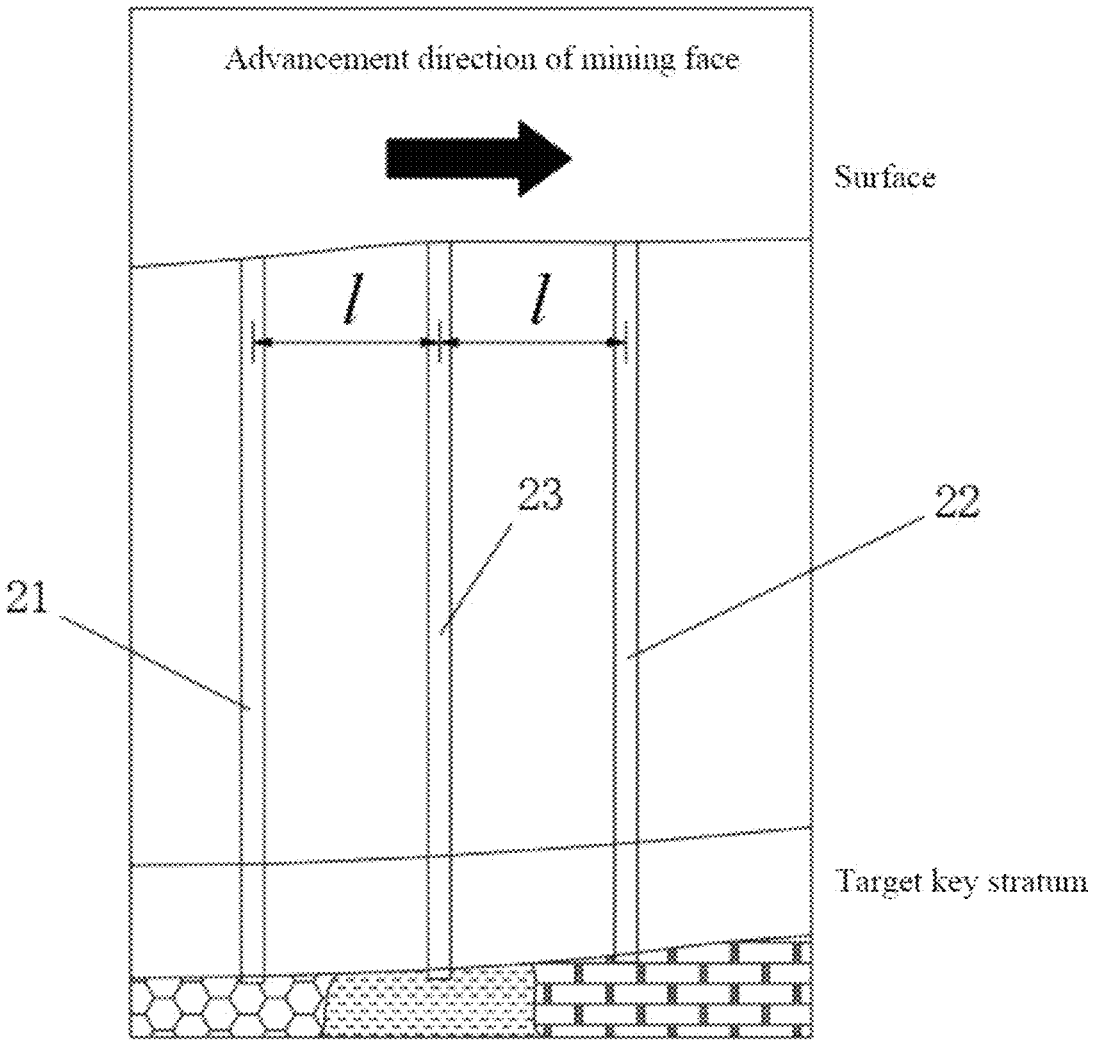
FIG. 5 is a cross-sectional schematic diagram of a combined plugging dam in an example of the present disclosure.

Along the advancement direction of the coal mining face and above the boundary of the protective coal pillar, there rows of dam grouting holes are constructed, with a periodic movement step distance 1 of the target key stratum as a drilling spacing, as shown in FIG. 4. FIG. 5 shows a schematic diagram of the combined plugging dam grouting. When the target separation stratum 6 develops to the location of the dam grouting hole 2, first-grade grout, second-grade grout, and third-grade grout are injected into the first-grade dam grouting holes 21, second-grade dam grouting holes 22, and third-grade dam grouting holes 23, respectively, to construct the combined plugging dam 4. The combined plugging dam 4 can isolate the remaining space 7 of the target separation stratum above the mined area from the space of undeveloped separation stratum in ahead of the advancement direction of the coal mining face. The grouting sequence is as follows.

1) The first-grade grout is injected into the first-grade dam grouting holes 21. The first-grade grout is prepared from quick-drying cement mixed with sawdust, crushed straw, and other materials (including but not limited to materials with equivalent effects).

2) The second-grade grout is injected into the second-grade dam grouting holes 22. The second-grade grout is prepared from ordinary cement mixed with sawdust, crushed straw, and other materials (including but not limited to materials with equivalent effects).

3) The third-grade grout is injected into the third-grade dam grouting holes 23. The third-grade grout is prepared from flyash mixed with sawdust, crushed straw, and other materials (including but not limited to materials with equivalent effects).

(3) The combined plugging dam is monitored and evaluated.

Figure 6:
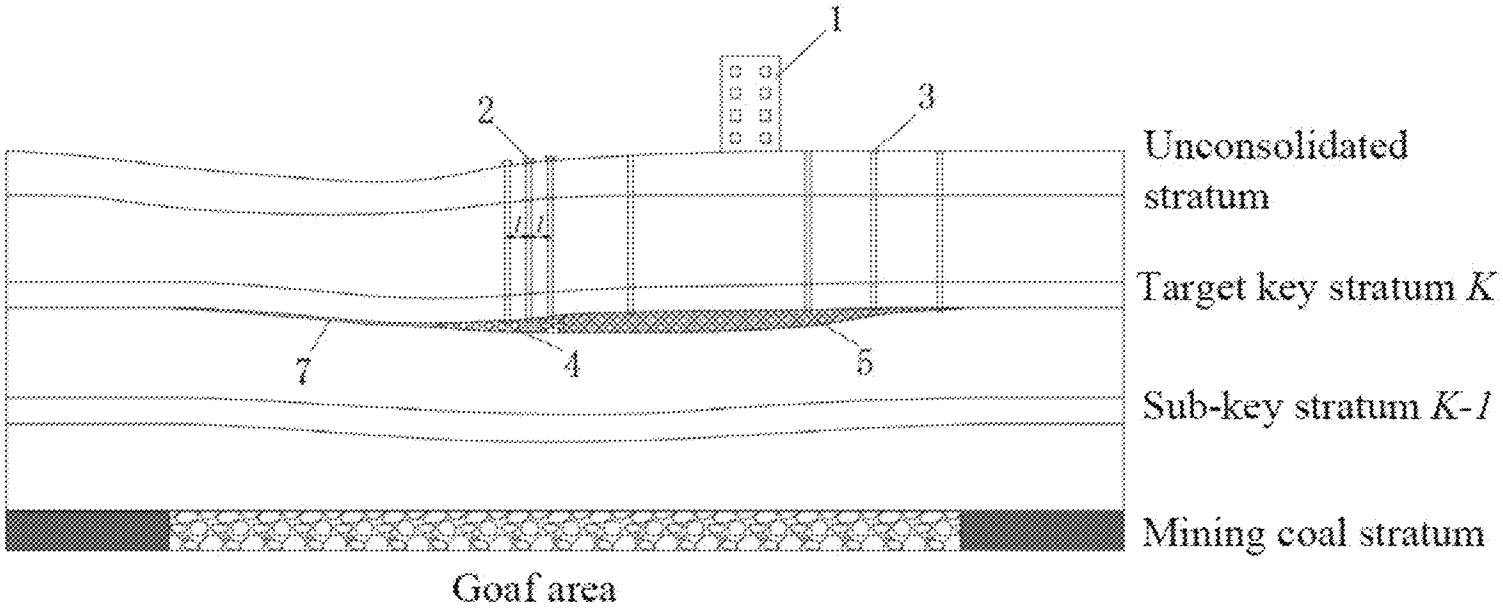
FIG. 6 is a schematic diagram showing separation stratum grouting and plugging under single-side open conditions in an example of the present disclosure.

After the construction of the combined plugging dam 4, the subsequent grouting work is continued. Ordinary grouting holes are constructed at an interval b behind the dam grouting holes along the advancement direction of the mining face. The interval b of the ordinary grouting holes is determined comprehensively based on grout diffusion radius and the size of mining face, etc. As the coal mining face advances, flyash grout 5 is injected into the space of the developing separation stratum 6 ahead of the combined plugging dam 4 through the ordinary grouting holes 3, as shown in FIG. 6.

The orifice grouting pressure of the dam grouting holes 2 can be determined through the following formula:

$$P_{hole} = P_{inject} - H_1\gamma_1 \geq P_{stratum} - H_1\gamma_1 = H_1(\gamma - \gamma_1) \quad (3)$$

where $P_{hole}$ represents the orifice grouting pressure of the grouting hole, in unit MPa; $P_{inject}$ represents a grouting filling pressure, in unit MPa; $P_{stratum}$ represents a natural pressure of the stratum above the grouting filling stratum, in unit MPa; $H_1$ represents a hole depth from the surface to the grouting filling horizon, in unit m; $\gamma$ represents comprehensive specific gravity of the stratum above the grouting filling stratum, in unit $kN/m^3$; and $\gamma_1$ represents specific gravity of the filling grout, in unit $kN/m^3$.

Before the coal mining face is mined, geophysical exploration and drilling exploration survey lines are laid out along the advancement direction of the mining face on the surface. After the construction of the combined plugging dam 4, during the advancement of the coal mining face, the condition of the combined plugging dam 4 is monitored by combining the orifice grouting pressure of the dam grouting holes 2, the geophysical exploration methods (such as direct current resistivity method, transient electromagnetic method, and seismic reflection method) and drilling exploration methods (such as borehole television imaging technology). Based on the orifice grouting pressure and the geophysical and drilling exploration results, it is determined whether there is grout leakage in the dam. Of course, the geophysical and drilling exploration methods adopted in this example belong to the prior art, and are not described further here since they are not the focus of the technical solution claimed for protection in the present disclosure. In a case that the orifice grouting pressure P remains relatively constant ($P=P_{hole}\pm20\%$) and the geophysical and drilling exploration results show no gaps between the dam and the overlying strata, it is considered that the combined plugging dam 4 is intact and there is no leakage. In a case that the orifice grouting pressure P keeps decreasing ($P<P_{hole}\pm20\%$) and the geophysical and drilling exploration results show gaps between the dam and the overlying strata, it is considered that there is grout leakage in the combined plugging dam 4, and local reinforcement of the combined plugging dam 4 is required. When grout leakage occurs in the combined plugging dam 4, the grout prepared from ultrafine cement, sawdust, crushed straw, and other materials (including but not limited to materials with equivalent effects) is injected under pressure through the dam grouting holes 2, to promote grout diffusion and achieve rapid plugging. At the same time, during the grouting plugging and subsequent grouting filling, the combined plugging dam 4 is continuously monitored by combining the grouting orifice pressure with the geophysical and drilling exploration methods, ensuring that the combined plugging dam 4 normally plugs the grout.

In the description of the present disclosure, the terms "first", "second", "another" and "yet another" are merely for describing the objective, rather than indicating or implying relative importance or indicating the quantity of technical features indicated. Therefore, a feature defined with "first" and "second" may include one or more of these features explicitly or implicitly. In the description of the embodiment of the present disclosure, unless otherwise stated, "a plurality of" means two or more.

In the description of the present disclosure, it is to be illustrated that, unless other expressly stated and qualified, such terms as "connect" and "connection" are to be understood in a broad sense. For example, the connection can be fixed connection, detachable connection and integrated connection; or mechanical connection and electrical connection; or direct connection or indirect connection through an intermediary. For those of ordinary skill in the art, the specific meanings of the above terms in the present disclosure can be understood according to specific circumstances.

Furthermore, in the description of the present disclosure, unless otherwise indicated, "a plurality of" means two or more.

Although the examples of the present disclosure have been provided and described, for those ordinary skilled in the art, it can be understood as various changes, modifications, replacements and variations can be made on these examples within the principle and spirit of the present disclosure. The scope of the present disclosure is defined by the attached claims and the equivalent thereof.

The invention claimed is:

1. A graded plugging, monitoring and reinforcing integrated method for separation stratum grouting under single-side open conditions, comprising the following steps:

S1. analyzing the development law of a separation stratum, and determining the scope of protective coal pillars for a surface building/structure;

S2. constructing a combined plugging dam to prevent grout from flowing and migrating towards the remaining space of a target separation stratum above a mined area during separation stratum grouting under single-side open conditions, comprising the following specific steps: constructing three rows of dam grouting holes at a surface above the boundary of the protective coal pillar along the advancement direction of a coal mining face, with a periodic movement step distance of a target key stratum as a drilling spacing, firstly injecting first-grade grout into first-grade dam grouting holes, then injecting second-grade grout into second-grade dam grouting holes, and finally injecting third-grade grout into third-grade dam grouting holes;

S3. monitoring and evaluating the combined plugging dam; and

S4. determining whether there is grout leakage in the combined plugging dam, if there is, performing local reinforcement on the combined plugging dam, and otherwise, requiring no local reinforcement;

wherein the separation stratum grouting under single-side open conditions refers to a partial separation stratum grouting and filling technique, involving that holes for separation stratum grouting are first drilled at a certain position ahead of the advancement direction of a coal mining face to a stop-mining line area;

wherein the periodic movement step distance of a target key stratum refers to the advancement length of the coal mining face after the target key stratum is periodically fractured;

wherein the first-grade dam grouting holes, the second-grade dam grouting holes and the third-grade dam grouting holes respectively refer to one of three kinds of grouting holes used for injecting grout into a separation stratum space below the target key stratum to construct a combined plugging dam during construction on a surface of the coal mining face, and the first-grade grout, the second-grade grout, and the third-grade grout refer to three kinds of grouts that correspond to the first-grade dam grouting holes, the second-grade dam grouting holes and the third-grade dam grouting holes, respectively;

wherein in S1, the analyzing the development law of a separation stratum, and determining the scope of protective coal pillars for a surface building/structure comprises the following steps: determining burial depth of coal stratum, scope of mining area, and mining height data according to relevant geological data; studying rock stratum movement characteristics, analyzing the development law of an overlying separation stratum, and clarifying grouting separation stratum horizon, whether the separation stratum is closed, and whether the key stratum is fractured by combining physical simulation, numerical simulation, a mechanical model, an equilibrium condition and a constitutive equation in mathematics; obtaining the periodic movement step distance of the target key stratum and a movement angle of rock stratum under the condition of separation stratum grouting according to the rock stratum movement characteristics and the development law of overlying separation stratum; and determining the boundary of protective coal pillars for the surface building/structure according to the obtained movement angle of rock stratum and a rock stratum thickness.

2. The graded plugging, monitoring and reinforcing integrated method for separation stratum grouting under single-side open conditions according to claim 1, wherein the scope of protective coal pillars for the surface building/structure under the condition of separation stratum grouting is expressed as:

$$L_b = L_{building} + 2(a + H_s/\tan\varphi + H_{d1}/\tan\beta + H_{d2}/\tan\delta)$$

where $L_b$ represents the scope of protective coal pillars for a building/structure; $L_{building}$ represents a length of the building/structure; a represents a safety distance; $H_s$ represents a thickness of an unconsolidated stratum; $\varphi$ represents a movement angle of the unconsolidated stratum; $H_{d1}$ represents a thickness of bedrock in a grouting stratum-unconsolidated stratum section; $\beta$ represents a movement angle of bedrock in the grouting stratum-unconsolidated stratum section; $H_{d2}$ represents a thickness of bedrock in a coal stratum-grouting stratum section; and $\delta$ represents a movement angle of bedrock in the coal stratum-grouting stratum section.

3. The graded plugging, monitoring and reinforcing integrated method for separation stratum grouting under single-side open conditions according to claim 2, wherein after determining the scope of protective coal pillars for the surface building/structure, along the advancement direction of the coal mining face, the dam grouting holes are constructed at a distance of L meters from the building/structure on the surface of the coal mining face:

$$L = a + H_s/\tan\varphi + H_{d1}/\tan\beta + H_{d2}/\tan\delta$$

where L represents the scope of protective coal pillars on the left side of the surface building/structure.

4. The graded plugging, monitoring and reinforcing integrated method for separation stratum grouting under single-side open conditions according to claim 3, wherein the first-grade grout is prepared from quick-drying cement, sawdust and crushed straw; the second-grade grout is prepared from ordinary cement, sawdust and crushed straw; and the third-grade grout is prepared from flyash, sawdust and crushed straw.

5. The graded plugging, monitoring and reinforcing integrated method for separation stratum grouting under single-side open conditions according to claim 1, wherein in S3, the condition of the combined plugging dam is monitored by combining orifice grouting pressure with geophysical exploration methods and drilling exploration methods; and whether there is grout leakage in the combined plugging dam is determined according to the magnitude of the orifice grouting pressure and geophysical and drilling exploration results.

6. The graded plugging, monitoring and reinforcing integrated method for separation stratum grouting under single-side open conditions according to claim 5, wherein the orifice grouting pressure is determined by the following formula:

$$P_{hole} = P_{inject} - H_1\gamma_1 \geq P_{stratum} - H_1\gamma_1 = H_1(\gamma - \gamma_1)$$

where $P_{hole}$ represents the orifice grouting pressure of the grouting hole; $P_{inject}$ represents a grouting filling pressure; $P_{stratum}$ represents a natural pressure of the stratum above the grouting filling stratum; $H_1$ represents a hole depth from the surface to the grouting filling horizon; $\gamma$ represents comprehensive specific gravity of the stratum above the grouting filling stratum; and $\gamma_1$ represents specific gravity of filling grout.

7. The graded plugging, monitoring and reinforcing integrated method for separation stratum grouting under single-side open conditions according to claim 6, wherein criteria for determining whether the combined plugging dam is leaking are as follows: in a case that the orifice grouting pressure P remains relatively constant and the geophysical and drilling exploration results show no gaps between the dam and an overlying rock stratum, the combined plugging dam is considered intact and without grout leakage; and in a case that the orifice grouting pressure P continuously decreases and the geophysical and drilling exploration results show gaps between the dam and the overlying rock stratum, the combined plugging dam is considered to be leaking, and local reinforcement of the combined plugging dam is required.

8. The graded plugging, monitoring and reinforcing integrated method for separation stratum grouting under single-side open conditions according to claim 7, wherein if it is determined that there is grout leakage in the combined plugging dam, the leakage is plugged by pressure grouting through the grouting holes of the combined plugging dam using grout prepared from ultrafine cement mixed with sawdust and crushed straw; and during grouting plugging of the combined plugging dam and subsequent grouting filling, the combined plugging dam is continuously monitored by combining the orifice grouting pressure with geophysical exploration methods and drilling exploration methods.

* * * * *